US005898141A

United States Patent [19]

Blalock et al.

[11] Patent Number: 5,898,141

[45] Date of Patent: Apr. 27, 1999

[54] SELECTION SWITCH PANEL FOR VENDING AND DISPENSING EQUIPMENT

[75] Inventors: D. Flay Blalock; Paul D. Miller; Arnold D. Phillips, all of Greensboro, N.C.

[73] Assignee: Gilbarco, Inc., Greensboro, N.C.

[21] Appl. No.: 08/896,479

[22] Filed: Jul. 18, 1997

[51] Int. Cl.[6] ..... H01H 21/80

[52] U.S. Cl. ..... 200/5 A; 200/343

[58] Field of Search ..... 200/5 A, 332, 200/343

[56] References Cited

U.S. PATENT DOCUMENTS

| | | | |
|---|---|---|---|
| 4,480,162 | 10/1984 | Greenwood | 200/343 X |
| 4,559,427 | 12/1985 | Dolson et al. | 200/343 X |
| 4,845,319 | 7/1989 | Watkins et al. | 200/5 A |
| 5,749,457 | 5/1998 | Castenada et al. | 200/343 |

*Primary Examiner*—Renee S. Luebke
*Attorney, Agent, or Firm*—Kennedy Covington Lobdell & Hickman

[57] ABSTRACT

A switch panel for use in dispensing equipment which includes a switch plate having a plurality of switch positions with each having an area for receiving and mounting a first electrical switch component thereat, and at least one switch activating selector button having a second electrical switch component fixed thereto. Mounting means are provided for pivotally mounting a selector button at each selected switch position by pressing mounting ears on the selector button through appropriate slots in the switch plate until openings in the selector button are engaged by pivot pins in the switch plate, all without using any tools or connecting elements. A flat membrane switch is used as one switch component, and the selector button is designed so that when contact is made with the flat membrane switch a flange on the selector button also engages the surface of the switch plate to absorb any excessive or abusive force exerted on the selector button, and a sealing flange may be mounted behind all of the slots in the switch plate to provide a seal preventing moisture from passing through the slots in the switch plate.

19 Claims, 8 Drawing Sheets

SELECTION SWITCH PANEL FOR VENDING AND DISPENSING EQUIPMENT

BACKGROUND OF THE INVENTION

The present invention relates generally to dispensing and vending equipment, and more particularly to equipment of this sort which utilizes selector buttons mounted in the equipment and arranged to be moved by a user in selecting the product to be disbursed or vended.

Manufacturers of dispensing and vending equipment usually make such equipment for a number of different customers, each of which has its own specifications for certain aspects of the equipment. However, manufacturing economy requires that the equipment for each customer be made with as little variation as possible in manufacturing and assembly procedures so as to eliminate as much customizing expenses as possible, and in some instances these competing interests are difficult to reconcile.

For example, manufacturers of gasoline dispensing pumps which are ultimately placed at service stations and the like generally make such pumps for a number of different oil and petroleum companies, many of which dispense different grades of gasolines. Thus, one such customer may require a gasoline dispensing station which pumps five different grades of gasoline from the same dispensing station, while another customer may pump only three or less different grades from the same dispensing station.

Heretofore, such gasoline dispensing stations, while having many components in common, generally require that the manufacturer customize at least the part of the gasoline dispensing station which includes the selector buttons which are to be pressed by the ultimate customer (e.g., the motorist purchasing the gasoline) so that the number and location of the selector buttons would meet the individual requirements for a particular gasoline dispensing station. This customization is relatively expensive in that it requires the switch plate for a particular dispensing station to be individually manufactured and installed in the dispensing station, and each selector button is then individually mounted at particular locations on the switch plate as specified by the customer using a large number of screws, bolts, and similar attachment devices that are installed utilizing conventional and generally tedious manual installation techniques, all of which significantly increases the costs of manufacture of the dispensing stations.

Additionally, each location at which a selector button is installed requires a number of slots for receiving the aforesaid screws, bolts, and the like, and more importantly, slots are formed in the switch plate to accommodate the movement of the selector button when it is pressed by the motorist, and conventional selector buttons are arranged in the switch plate so that they seal these slots only when the selector buttons are in their normal open position from which they are pressed by the motorists. Therefore, if the selector buttons are pressed when there is significant moisture from rainfall and the like, water frequently passes through the slots and into the space behind the switch plate where a variety of electrical components are located to thereby create a potentially hazardous situation for the motorists. Heretofore, the only solution to this problem has been to provide a trough for collecting and channeling away any water that passes through the slots and openings in the switch plate, which has not proved to be a very effective solution to a serious problem.

Finally, conventional selector buttons are designed to close a conventional mechanical/electrical switch when it is pushed to its innermost position by the motorist, and these selector buttons are frequently abused, either intentionally or accidentally, by motorist who push the selector button inwardly with too much force, which often results in the selector switch sticking in its innermost position, in which case the entire dispensing station is out of commission until a repairman can correct the problem. Experience has shown that this abuse of the selector switch is one of the biggest, if not the biggest, maintenance problems associated with gasoline dispensing stations.

BRIEF SUMMARY OF THE INVENTION

The present invention provides a switch panel for use in dispensing equipment which includes a switch plate having a plurality of switch positions located at predetermined locations on the switch plate, with each switch position having a receptacle for receiving and mounting a first electrical switch component thereat, and at least one switch activating selector button having a second electrical switch component fixed thereto. A mounting arrangement is provided for pivotally mounting the switch selector button to the switch plate at any one or more of the aforesaid switch positions, and such mounting arrangement includes a slot arrangement formed in the switch plate at each switch position adjacent the first electrical switch component, and having a first pivot connector component associated therewith. A projection is formed on the switch selector button to be selectively received in the slot arrangement at any one of the switch positions, and the selector button includes a second pivot connector component associated therewith, wherein the first and second pivot connector components constitute the sole mounting connection between the switch plate and the switch selector button and wherein the slot means and the projection means are configured to position the switch selector button relative to the switch plate so that the first and second electrical switch components will make contact during the pivotal movement of the selector button.

In the preferred embodiment of the present invention, the slot arrangement includes at least two slots at each switch position. The first pivot connector includes a pivot pin located at each of the two slots, and the projection on the selector button includes a pair of spaced ears formed with openings therein for receiving one of the pivot pins, the ears being sufficiently resilient to permit flexing thereof away from the pivots pins when the projection is inserted in the slots until the openings in the ears are aligned with the pivot pins, and to permit flexing thereof toward the pivot pins when the openings and the pivot pins are aligned until the pivot pins are received in the openings, whereby the selector button can be pivotally mounted on the switch plate at any one of the pivot positions without the use of any tools. Each of the slots in the switch plate may include an enlarged portion at which one of the pivot pins is located, and a narrow portion for receiving the ears of the selector button, with the narrow portion and the ears having substantially the same dimension to provide a close tolerance of movement therebetween when the selector button is pivoted.

The selector button is preferably pivotally moved between a first extended position with the electrical contacts spaced from one another, and a second engaged position at which the first and second electrical switch components are in electrical contact with one another, and the selector button preferably includes a peripheral flange extending toward the switch plate so that at the second engaged position the peripheral flange engages the adjacent surface of the switch panel to inhibit breakage and damage if the selector button is abused by a customer. The switch plate may also include a third opening at each switch position, and the first electrical switch component is preferably a flat membrane switch that extends across the third opening, and the second electrical switch component preferably comprises a projection arranged on the selector button to extend into the third opening and contact the membrane switch at the second engaged position of the selector button.

The pivotal movement of the selector button is preferably limited by a retaining flange that is fixed to the switch plate and extends partially into the aforesaid third opening, and the projection on the selector button includes a retaining shoulder for receiving the retaining flange, the retaining shoulder and the retaining flange being dimensioned to permit the retaining flange to move freely during the pivotal movement of the selector button and to prevent separation of the selector button from the switch plate by engagement of the retaining flange with the retaining shoulder. The extending end of the retaining flange may be beveled to permit the retaining flange to pass over the selector button projection when the selector button is mounted in the switch plate.

A gasket may be mounted on the switch plate to extend across all three the openings at each the switch position to thereby provide a seal that prevents liquids from passing through the openings, and a spring element is preferably wedged between each selector button and the switch plate and maintained in place thereat solely by the wedged mounting, with the spring element yieldably urging the selector button away from the switch plate.

The present invention also provides a method of installing switch activating selector buttons in a switch panel used in dispensing equipment, such method comprising the steps of: providing a switch plate having a plurality of switch positions located at predetermined locations on the switch plate; locating slots at each of switch positions and providing the slots with a first pivot connection component; mounting a first electrical switch component at selected ones of the switch positions; providing a plurality of selector buttons, each formed with projections and a second pivot connection component; mounting a second electrical switch component on each of the selector buttons; and installing the selector buttons on the switch plate only at the selected ones of the switch positions by inserting the selector button projections into the slots so that the first and second pivot connection components are engaged and provide a pivotal mounting of the selector buttons on the switch plate and so that the first and second electrical switch components are positioned relative to one another to be engaged at one pivoted position of the selector buttons and disengaged at another pivoted position of the selector buttons.

This method may also include the step of mounting a cover piece over each the switch position other than the selected ones of the switch positions, and may include the step of positioning a spring element on the selector button before installing the selector button on the switch plate, and causing the spring element to be wedged between the selector button and the switch plate and maintained in place thereat after the selector button is installed, whereby the spring element will yieldably urge the selector button toward the other position thereof.

Preferably, the step of mounting the first electrical switch component includes installing an electrical membrane switch component, and the method may have an additional step of causing a flange on the selector button to make contact with the switch plate when the selector button is pivoted to its aforesaid one position at which the electrical switch components are engaged, to thereby prevent damage to the switch unit if a user abuses the selector button by pressing ti with excessive force.

DESCRIPTION OF THE PREFERRED EMBODIMENT

Figure 1:
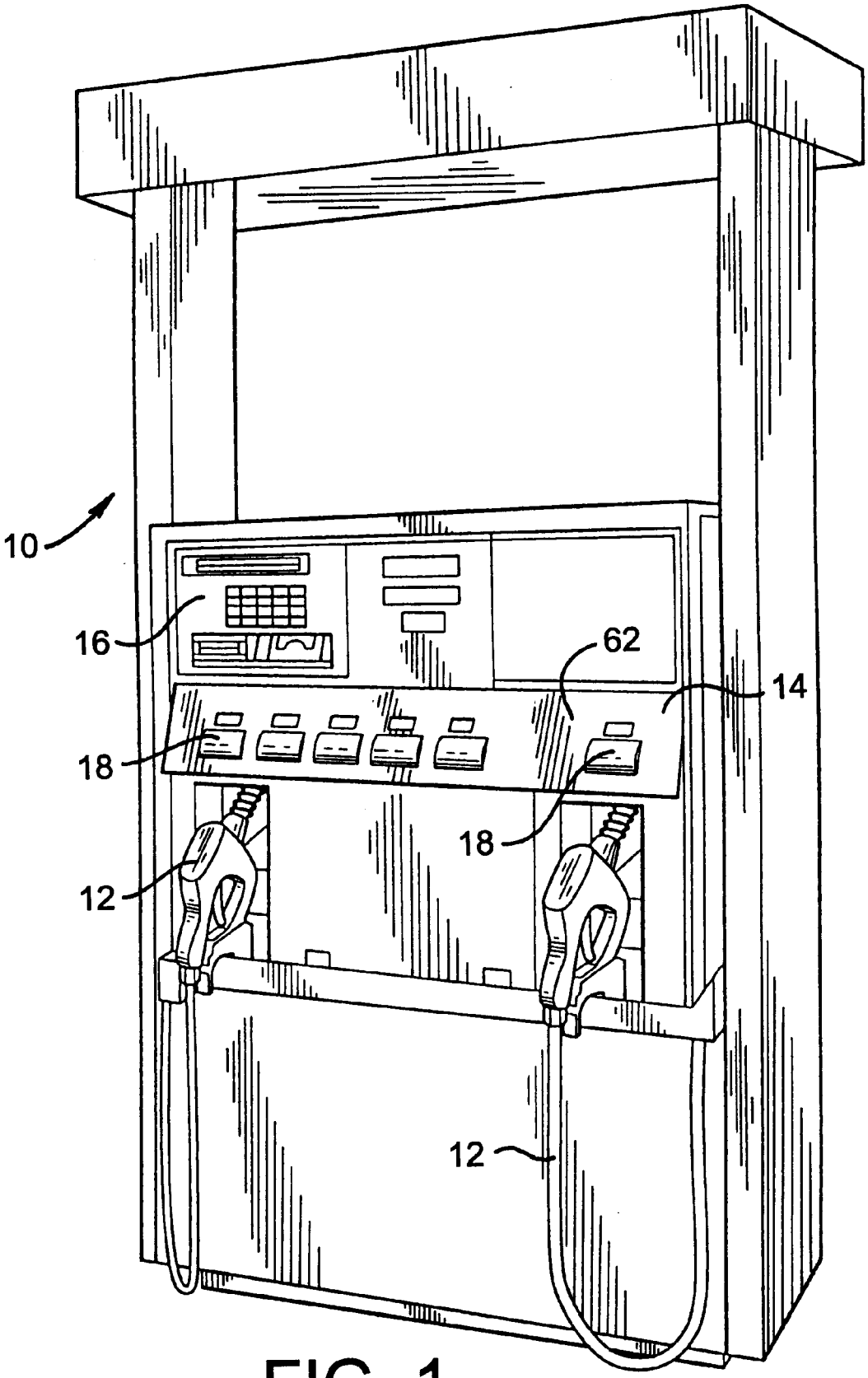
FIG. 1 is a front view of a gasoline dispensing position at a station embodying the present invention.

Looking now in greater detail at the accompanying drawings, FIG. 1 illustrates a gasoline dispensing station 10 which embodies the switch panel of the present invention, but it is to be understood that the switch panel of the present invention may have many other applications in dispensing and vending equipment of various types. The gasoline dispensing station 10 includes a hose and nozzle combination 12, a display panel 14 indicating which grades of gasoline are available at the gasoline dispensing station 10, and a control panel 16 by which the user may select a method of payment, all of which are conventional and form no part of the present invention.

Additionally, the gasoline dispensing station 10 includes a plurality of selector buttons 18, with one selector button 18 being provided for each grade of gasoline that is available from the gasoline dispensing station 10, which are operated by the user to select the desired grade of gasoline, all in a manner to be described in greater detail presently.

Figure 2:
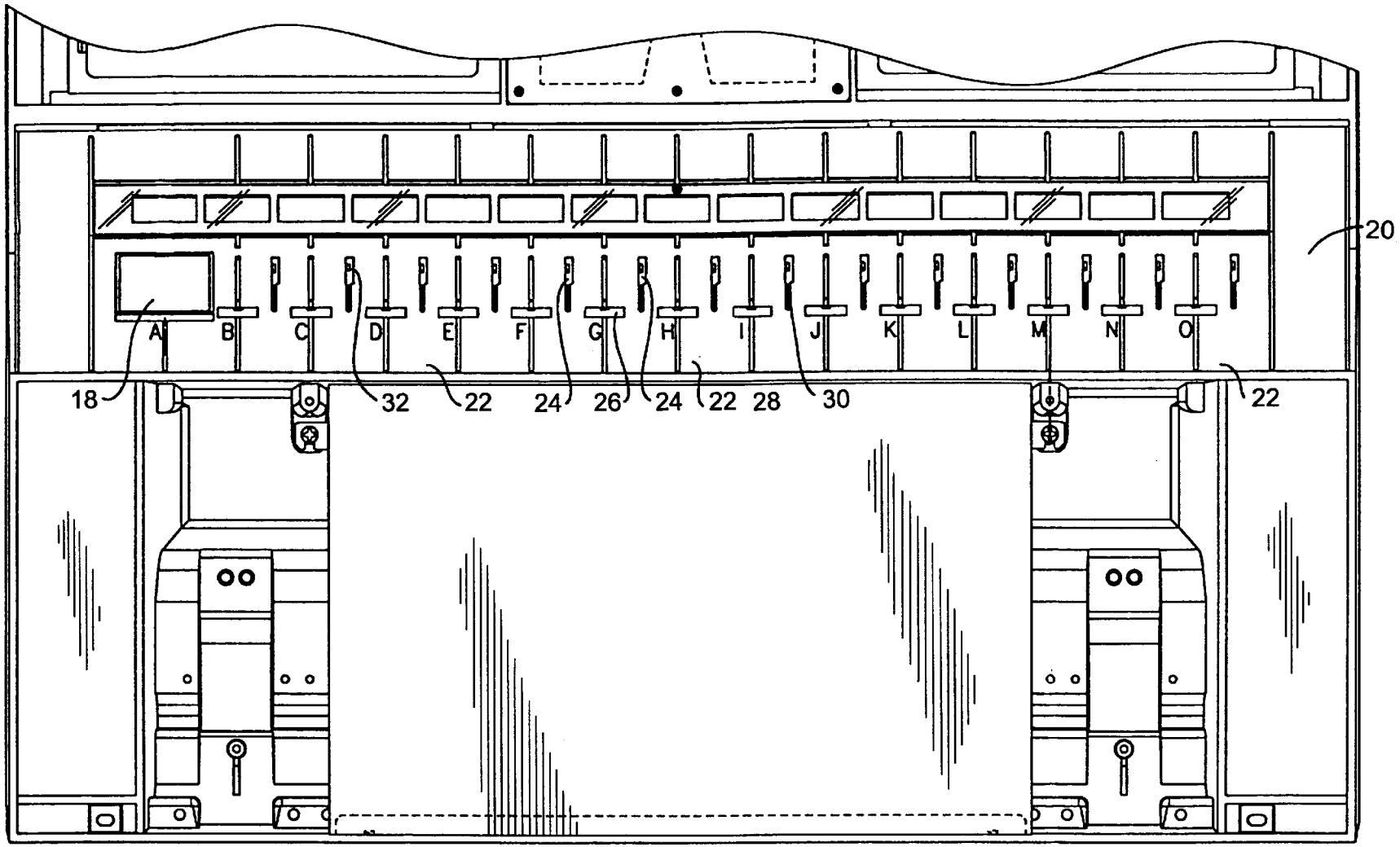
FIG. 2 is a front view of the switch panel or bezel of the gasoline dispensing station.

As best seen in FIG. 2, a switch panel 20, which is sometimes referred to in the trade as a bezel, is mounted within the confines of the gasoline dispensing station 10, and the switch panel 20 includes a plurality of switch positions 22 located at predetermined side-by-side locations on the switch plate 20 and identified by the letters A–O, and the left-hand switch position in FIG. 2 is illustrated with a selector button 18 mounted therein. In FIG. 2, fifteen switch positions 22 are shown, but it is to be expressly understood that this number may vary, depending on the type of gasoline dispensing stations 10 being manufactured. Each switch position 22 includes a slot arrangement that comprises a pair of vertically extending, parallel slots 24 and a horizontally extending slot 26 located intermediate each two vertical slots 24, and it will be noted that each of the vertical slots 24 includes an enlarged portion 28 and a relatively narrow portion 30, and a pivot pin 32 extends horizontally into each enlarged portion 28, all for a purpose to be explained in greater detail below.

Figure 3:
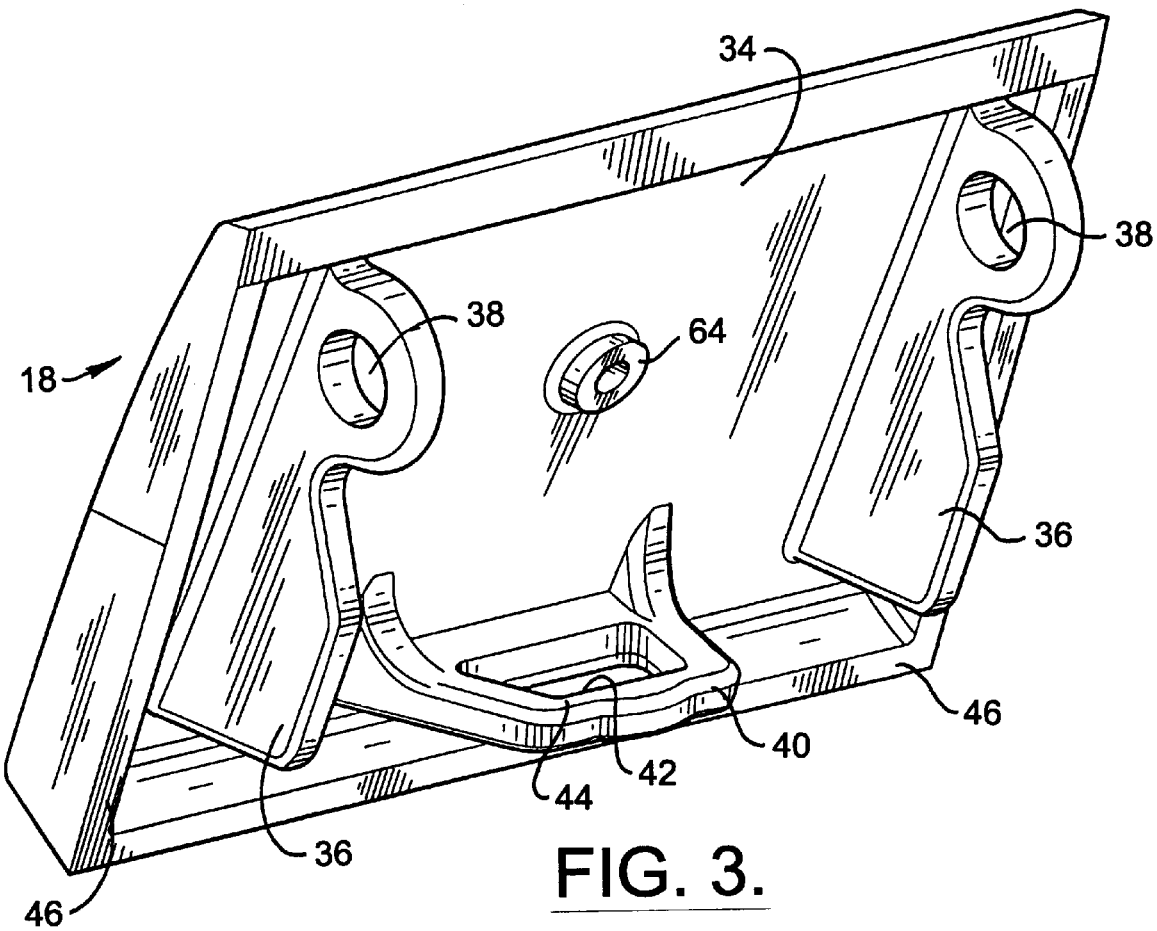
FIG. 3 is a perspective view of a selector button used in connection with the present invention.

FIG. 3 is a perspective view of one of the selector buttons 18 utilized in the present invention, and the selector button 18 includes a generally flat portion 34 on which a conventional sticker (not shown) may be mounted with an adhesive to display the particular octane rating that will be dispensed when that particular selector button 18 is operated. A pair of relatively thin ears 36 extend inwardly from the back surface of the flat portion 34 in perpendicular relation thereto, and they extend in parallel relation to one another, with each ear 36 having an opening 38 extending therethrough at its upper end. A projection 40 also extends inwardly from the back surface of the flat portion 34 at an acute angle relative thereto, and this projection includes an opening 42 formed therein and a retaining shoulder 44 (see FIG. 6) formed adjacent the extending end of the projection 40. The selector button 18 also includes a peripheral flange 46 which extends inwardly from the bottom and the two side edges of the flat portion 34.

One of the features of the present invention is that one or more of the selector buttons 18 may be mounted at any one or more of the switch positions 22 on the switch plate 20, which permits the manufacture of the gasoline dispensing station 10 to customize the gasoline dispensing station 10 to accommodate the individual needs of a particular customer. As discussed above, some customers will dispense only three gasolines having different octane ratings, in which case only three selector buttons 18 need to be mounted on the switch plate 20, whereas another customer may want to dispense five or more gasolines having different octane ratings, in which case an equal number of selector buttons 18 will be mounted in the switch plate 20. Moreover, different customers may require that the selector buttons 18 be located at varying positions across the width of the switch plate 20. All of these variations required by different customers are readily accommodated by the present invention by virtue of the fact that the same switch plate 20, with its large plurality of available switch positions 22, can be used in meeting the needs of any customer, and by virtue of the fact that the universal selector button 18 can be mounted at any selected ones of the switch positions 22 as will be described below, the switch plate arrangement of the present invention is easily customized to meet the different requirements of different customers without any required changes in the structure of the gasoline dispensing station 10.

Figure 7:
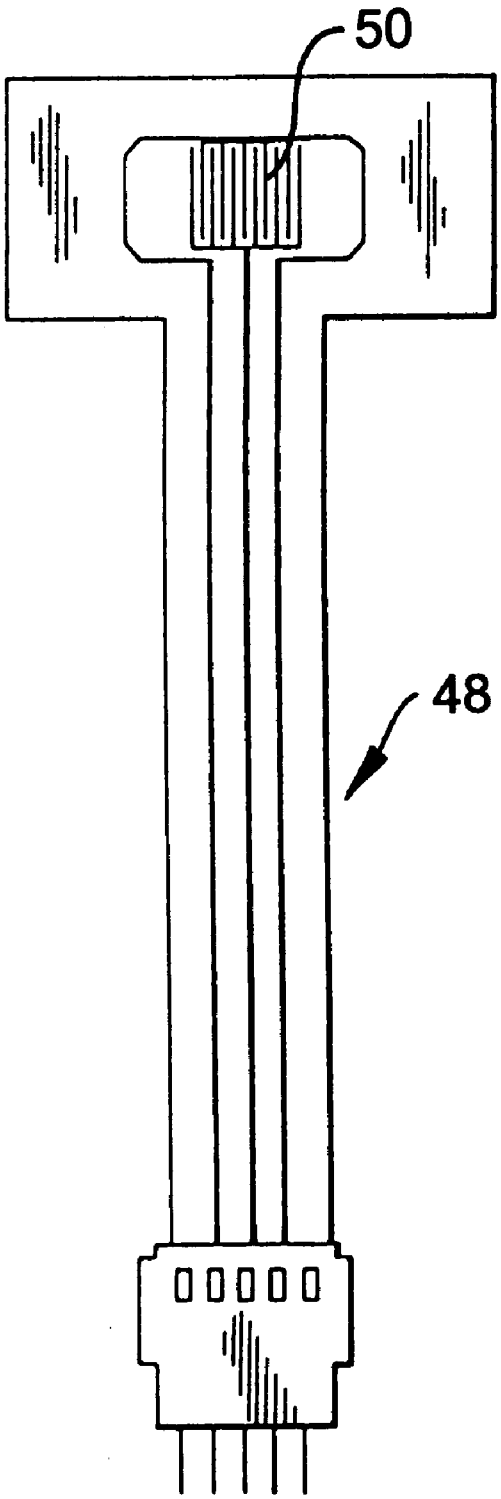
FIG. 7 is a detailed plan view of the membrane switch used in the present invention.

More specifically, once it is determined from the customer how many selector buttons 18 will be needed to meet that customer's requirements, and after the desired locations for the selector buttons 18 are also determined, appropriate switch positions 22 are selected for installation of selector buttons 18. At each selected switch position 22, a conventional thin, flat membrane switch 48 (see FIGS. 4 and 7) is mounted behind the switch plate 20 using a suitable adhesive, and the membrane switch 48 is located so that the contact area 50 thereof is positioned directly behind the horizontal slot 26 in the switch plate 20.

Figure 6:
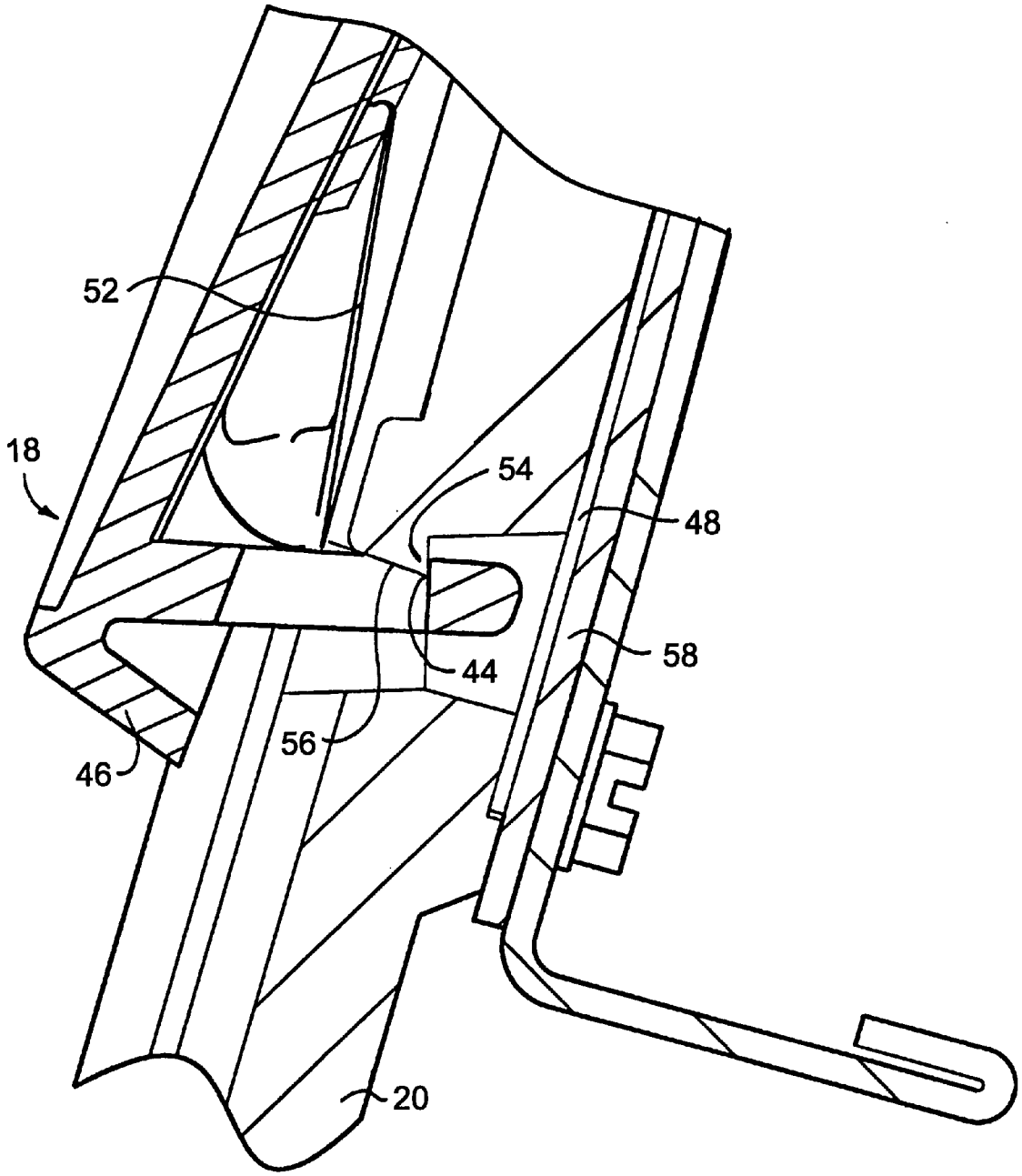
FIG. 6 is a detailed view of the bottom portion of the selector button and the adjacent portion of the switch panel.
Figure 8:
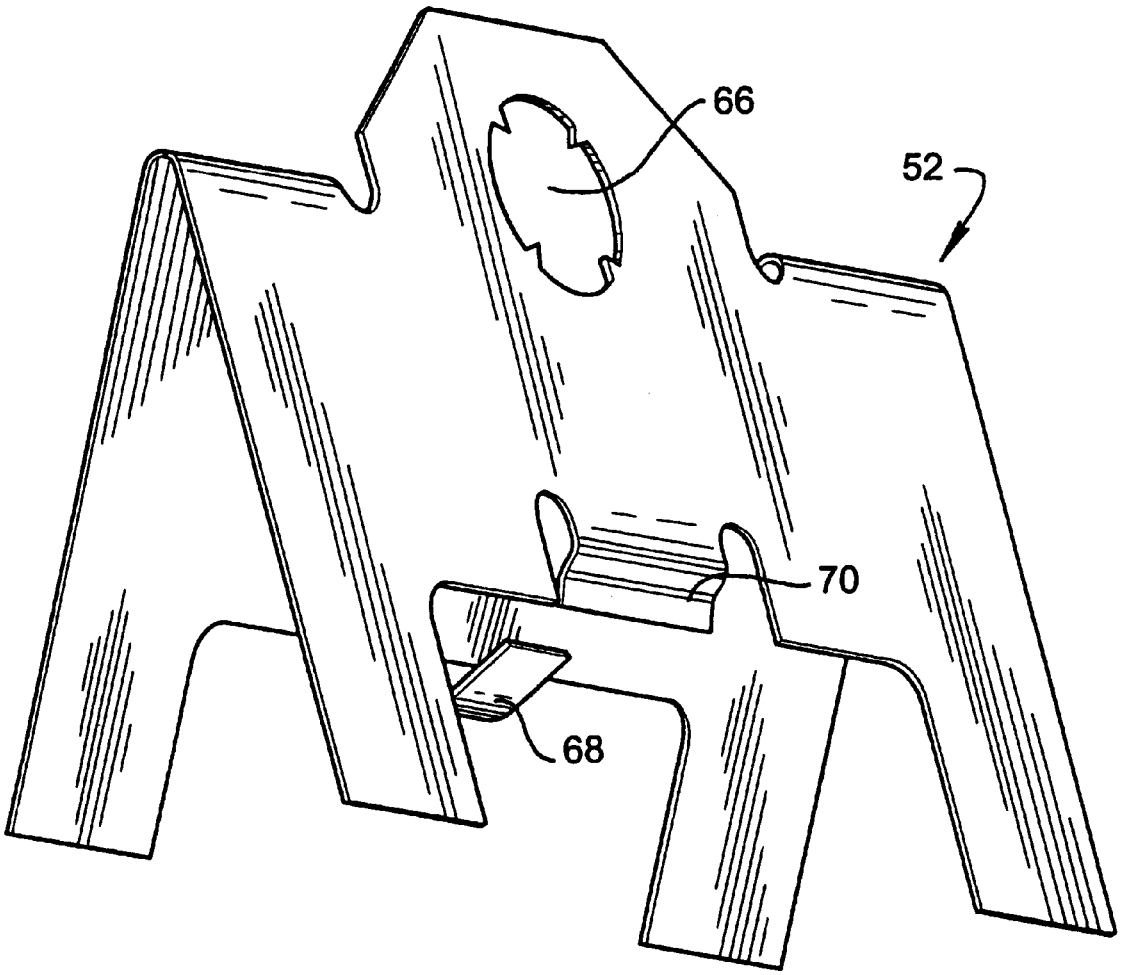
FIG. 8 is a perspective view of a spring element used in the present invention.

Next, a resilient spring member 52 illustrated in FIG. 8 is positioned on the back surface of the flat portion 34 of a selector button 18, and this spring member 52 is maintained in place on the back side of the flat portion 34 simply by pressing the circular tab 64 on the back of the selector button 18 through the opening 66 in the spring member 52, and it will be noted that no tools, screws, or other attachment devices are required to hold the spring member 52 in place. A selector button 18, with a spring member 52 in place, is then installed at each of the three selected switch positions 22 in the following manner. The two ears 36 are inserted into the two vertical slots 24 of each selected switch position 22, and the ears 36 are sufficiently resilient so that, as the upper portion of the ears are pressed into the enlarged portions 28 of the vertical slots 24, the ears 36 will flex outwardly away from the pivot pin 32 in each vertical slot 24 until the pivot pins 32 are aligned with the openings 38 at the upper end of the ears 36, whereupon the pivot pins 32 will extend into the openings 38 and provide a pivotal connection between the selector button 18 and the switch plate 20. Then, the lower projection 40 of the selector button 18 is pushed into the lower horizontal slot 26 at each selected switch position 22 so that the retaining shoulder 44, as best seen in FIG. 6, rides over a projection 54 that extends downwardly into the horizontal slot 26 until the retaining shoulder 44 engages the back surface of the projection 54 to thereby prevent the selector button 18 from thereafter being inadvertently pulled outwardly from the switch plate 20. In this regard, it will be noted that the bottom edge 56 of the projection 54 is beveled to create a camming surface causing the projection 40 on the selector button 18 to flex downwardly until the retaining shoulder 44 clears the projection 54, whereupon the projection 40 flexes upwardly to engage the retaining shoulder 44 with the back surface of the projection 54 (see FIG. 6). It will also be noted that the retaining shoulder 54 is free to move within the opening 42 during pivotal movement of the selector button 18 about the pivot pins 32.

Thus, it is significant to note that, not only can the selector buttons 18 be mounted at selected ones of the plurality of switch positions 22, each selector button can be mounted by simply pressing the selector button into the slots 24,26 at each selected switch position 20, all without requiring any tools and without requiring any attachment devices such as screws, bolts and the like. This is in substantial contrast to conventional dispensing stations of this type where each selector button was individually installed manually by the somewhat tedious process of connecting screws and bolts in very confined areas.

Figure 4:
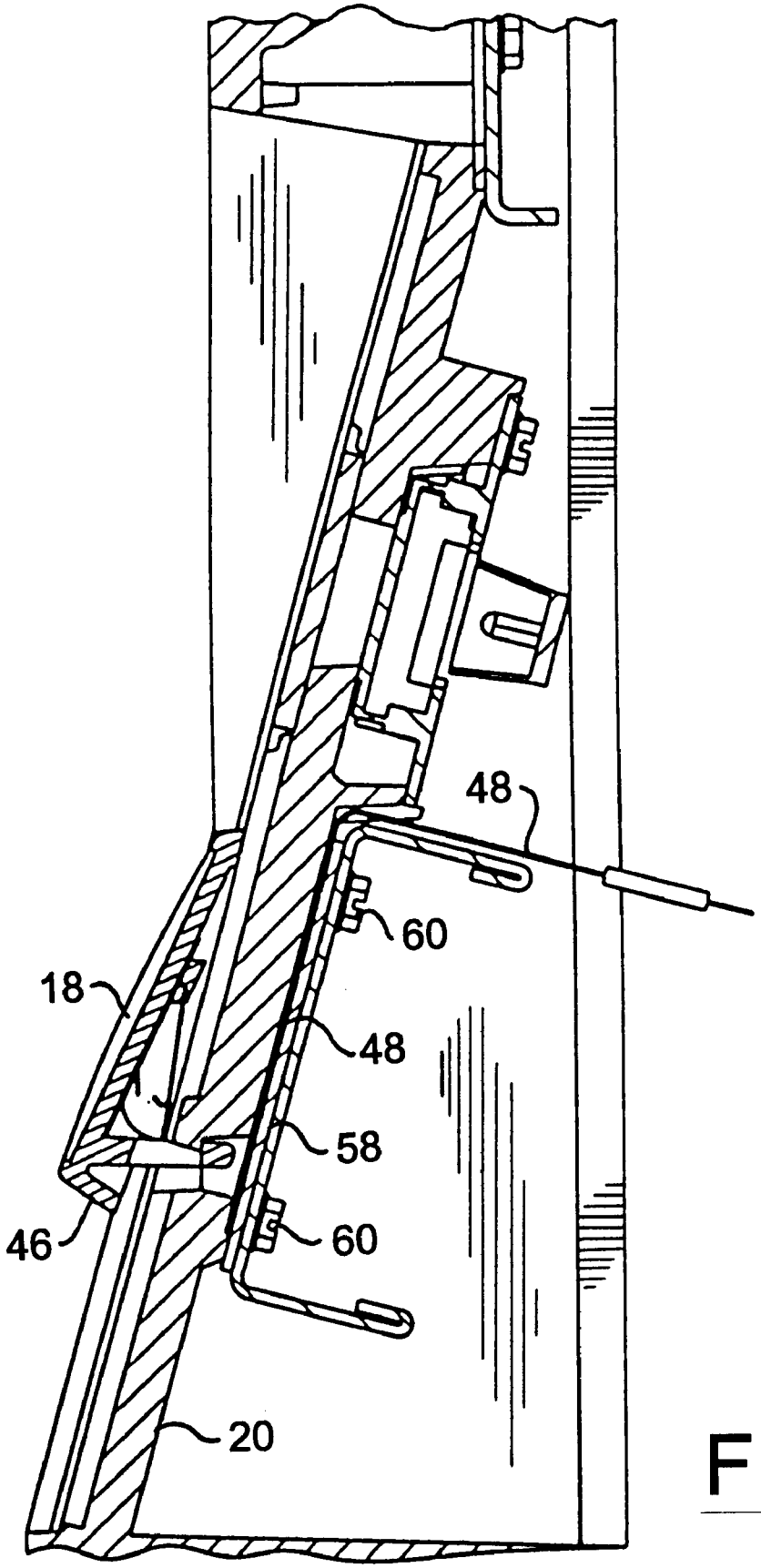
FIG. 4 is a detailed view of one selector button disposed at its open position on the switch panel.

After a selector button 18 has been installed at each of the selected switch positions 22 as described above, the spring member 52 will be wedged between the selector button 18 and the front surface of the switch plate 20 as best seen in FIG. 4, and the spring member 52 urges the spring button away from the switch plate 20 so that the switch button 18 is normally in its extended or open position as shown in FIG. 4. When the user of the gasoline dispensing station 10 presses a desired selector button 18 to select a gasoline having a particular octane rating, the user presses the button 18 against the bias of the spring member 52 so that the projection 40 will contact the contact area 50 of the membrane switch 80, which "closes" the switch to begin pumping the selected gasoline in the conventional manner. The spring member 52 is provided with cooperating clicker elements 68,70 which will engage one another and provide an audible "clicking" sound to notify the user that the switch has been closed.

Figure 5:
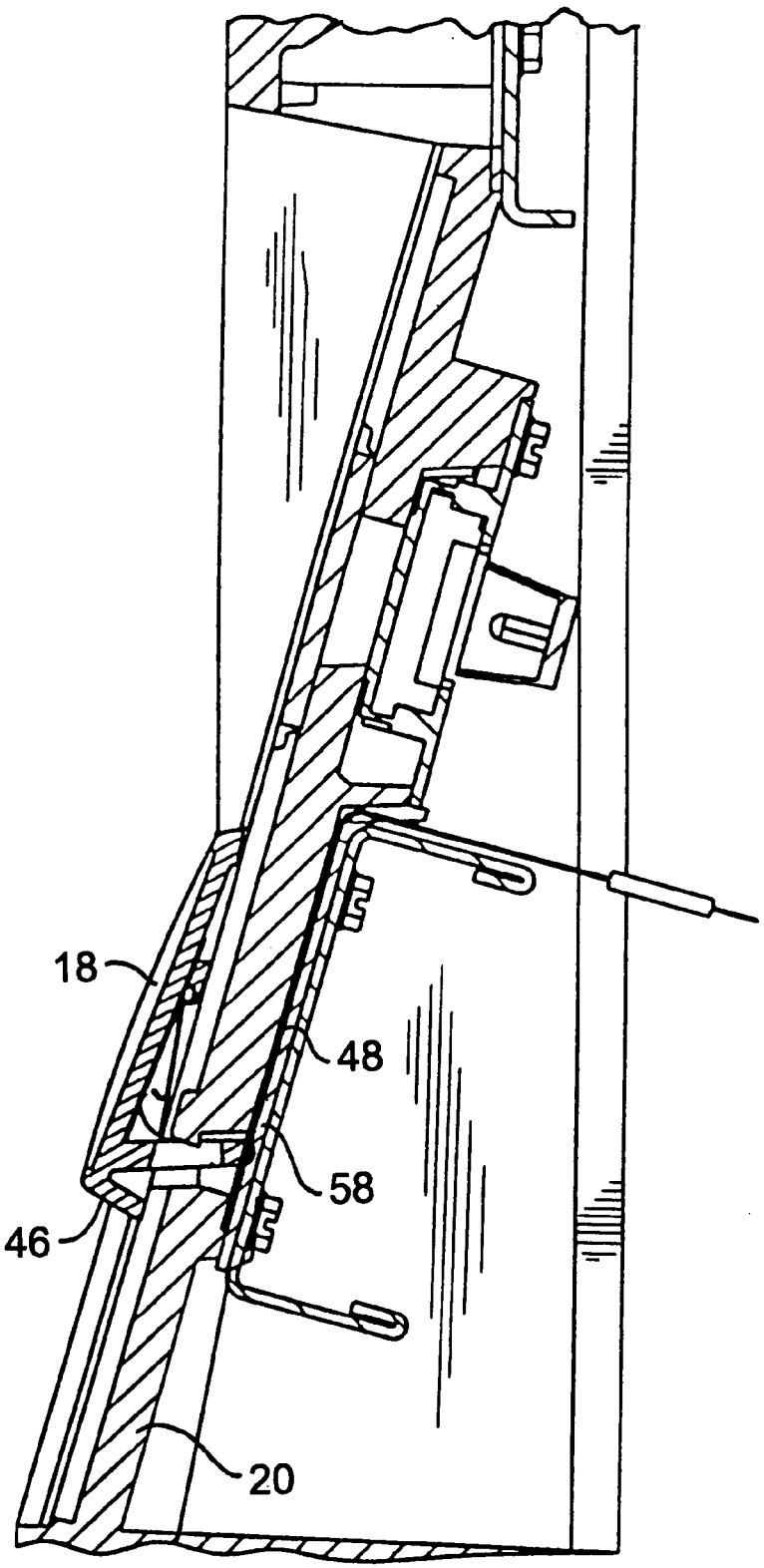
FIG. 5 is a detailed view, similar to FIG. 4, showing a selector button at its closed position on the switch panel.

In accordance with another feature of the present invention, the peripheral flange 46 on the selector button 18 is configured so that the entire bottom edge of the peripheral flange 46 will make contact with the facing surface of the switch plate 20 at the same time that the projection 40 contacts the contact area 50 of the membrane switch 48. Accordingly, even if the user presses the selector button 18 to its closed position as shown in FIG. 5 with excessive force, or even with abusive force, it is absorbed by the peripheral flange 46 contacting the switch plate 20, so that no damage is done to the switch components consisting of the membrane switch and the projection 40, and the selector button 18 will freely return to its open position as shown in FIG. 4 when the selector button 18 is released. Again, this is in significant contrast to conventional selector button mountings where excessive force applied thereto will damage the switch portions of the unit and/or cause the selector button to stick at its closed position, all as discussed above.

In accordance with another feature of the present invention, a sealing gasket 58 may be mounted by screws 60 to the back surface of the switch plate 20 so that it extends across and behind all of the slots 24,26 so as to prevent any water or other liquid from passing through the slots during inclement weather. Since the switch components consist of the flat membrane switch 48 which is engaged by the projection 40, it is not necessary for the projection 40 to extend all the way through and behind the switch plate 20, and since, likewise, the mounting ears 36 of the selector button 18 are contained within the slots 22 in the switch plate 20, the sealing gasket 58 can be readily attached across the entire back surface of the switch plate 20 without interfering with any of the operating components of the switch button 18 and the switch components 40,48. With regard to the positioning of the ears 36 within the vertical slots 34, the enlarged portion 28 of each vertical slot 24 can readily receive the upper portion of the ears 36 and accommodate flexing thereof to mount the ears 36 on the pivot pins 32 as discussed above, and the lower narrow portion 30 of each slot is dimensioned to have a width just slightly greater than the width of the ears 36 to provide a close tolerance of movement therebetween when the selector button 18 is pivoted between its open and closed positions, thereby limiting any undesirable sideways movement of the selector button 18 relative to the switch plate 20 during pivotal movement of the selector button 18.

Finally, after selector buttons 18 have been properly installed at the selected switch positions 22 in the manner described above, cover pieces 62 (see FIG. 1) can be mounted on the outer surface of the switch plate 20 to cover all of the switch positions 22 which do not have a selector button 18 mounted therein, so as to present an aesthetically pleasing appearance at the switch plate 20, regardless of the number and location of switch positions 22 which have a selector button mounted therein.

It will therefore be readily understood by those persons skilled in the art that the present invention is susceptible of a broad utility and application. Many embodiments and adaptations of the present invention other than those herein described, as well as many variations, modifications and equivalent arrangements, will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

We claim:

1. A switch panel for use in dispensing equipment, comprising:

(a) a switch plate including a first switch position having a switch component and a pair of generally parallel slots formed on opposite sides of said switch component; and (b) a first selector button including (i) a pair of ears with each ear extending partially into a respective said slot, and (ii) a projection extending between said ears toward said switch component, each said ear pivotally connecting said selector button to said switch plate for pivotal movement of said first selector button between first and second pivotal positions, said projection engaging and activating said switch component when said selector button is in said first pivotal position.

2. A switch panel as defined in claim 1, wherein said switch plate includes two pivot pins each respectively extending in one of said two slots at said first switch position and wherein said ears are each formed with an opening therein for receiving a respective said pivot pin.

3. A switch plate as defined in claim 2, wherein each of said slots in said switch plate includes a narrow portion and an enlarged portion in which said pivot pin is located, wherein said narrow portion and said ears have substantially the same dimension to provide a close tolerance of movement therebetween when said first selector button is pivoted, and wherein said ears are sufficiently resilient to permit flexing thereof away from said pivots pins when said ears are inserted in said respective slots and to permit flexing thereof towards said pivot pins when said pivot pin are aligned with and received in said openings, whereby said first selector button can be pivotally mounted on said switch plate at said first switch position without the use of any tools.

4. A switch panel as defined in claim 3, wherein said switch plate includes a plurality of switch positions identical to said first switch position whereby other selector buttons identical to said first selector button can be pivotally mounted on said switch plate at selected ones of said switch positions without the use of any tools.

5. A switch panel as defined in claim 4, wherein said first selector button is formed with a peripheral flange extending toward said switch plate that engages an adjacent surface of said switch plate when said projection engages said switch component to inhibit breakage if said first selector button is pressed with excessive pushing force.

6. A switch panel as defined in claim 4, wherein said switch plate includes a transverse opening extending between said pair of slots at said first switch location, wherein said first switch component comprises a flat membrane switch extending across said transverse opening, and wherein said projection is arranged on said first selector button to extend into said transverse opening when said first selector button moves between said first and said second pivotal positions.

7. A switch panel as defined in claim 6, wherein a gasket is mounted on said switch plate and extends across said slots and said transverse opening to thereby provide a seal that prevents liquid from passing through said slots and said transverse opening into the dispensing equipment.

8. A switch panel as defined in claim 1, wherein said switch plate includes a transverse opening between said air of slots at said first switch location, wherein a retaining shoulder of said switch plate extends partially into said transverse opening, and wherein said projection on said first selector button includes a retaining flange for engaging said retaining shoulder when said first selector button is in said second pivotal position, said retaining shoulder and said retaining flange being dimensioned to limit said pivotal movement of said first selector button further from said switch component at said second pivotal position and to prevent said first selector button from being pulled out from said switch plate.

9. A switch panel as defined in claim 8, wherein an extending end of said retaining shoulder is beveled to permit said retaining flange of said first selector button to pass over said retaining shoulder when said first selector button is installed at said first switch position on said switch plate.

10. A switch panel as defined in claim 1, further including a spring element wedged between said first selector button and said switch plate and maintained in place thereat by said wedged condition, said spring element yieldingly urging said first selector button away from said switch plate into said second pivotal position.

11. A method of installing selector buttons in a switch panel used in dispensing equipment, comprising the steps of:

(a) providing a switch plate having a plurality of switch positions located at predetermined locations on the switch plate;

(b) locating slots at each of the switch positions and providing said slots each with a first pivot connection component;

(c) mounting a first switch component at selected ones of the switch positions;

(d) providing a plurality of selector buttons, each including a second switch component, ear portions, and a second pivot connection component;

(e) installing the selector buttons on the switch plate only at the selected ones of the switch positions by inserting the ear portions of each selector button into the slots of each switch position so that the first and the second pivot connection components engage and provide a pivotal mounting for the selector button at the switch position on the switch plate, and so that the first and second switch components are arranged to be engaged at one pivoted position of the selector button and disengaged at another pivoted position of the selector button.

12. A method of installing selector buttons in a switch panel as defined in claim 11, wherein the method further includes the step of mounting a cover piece over each switch position excluding the selected switch positions whereat the selector buttons are installed.

13. A method of installing selector buttons in a switch panel as defined in claim 11, wherein the method further includes the step of positioning a spring element on each selector button that is to be installed on the switch plate, and causing the spring element to be wedged between the selector button and the switch plate and maintained in place thereat after the selector button is installed, whereby the spring element will yieldingly urge the selector button toward the other position thereof.

14. A method of installing selector buttons in a switch panel as defined in claim 11, wherein the step of mounting the first switch component includes mounting an electrical membrane switch component.

15. A method of installing selector buttons in a switch panel as defined in claim 11, wherein the step of installing the selector buttons includes installing each selector button whereby each selector button will make planar contact with the switch plate when the selector button is pivoted to the one pivoted position thereof.

16. A switch panel, comprising:

(a) a planar switch plate including a first switch position having a switch component and an opening formed in said switch plate, and including pivot pin extending in said opening at said switch position; and (b) a first selector button which partially extends into said opening, which includes a projection extending toward said switch component, and which defines an opening for receiving therethrough said pivot pin for pivotal mounting of said selector button to said switch plate for pivotal movement between first and second pivotal positions, said projection engaging and activating said switch component when said selector button is moved to said first pivotal position.

17. A switch panel according to claim 16, wherein said switch plate further includes a plurality of switch positions identical to said first switch position.

18. A switch panel, comprising:

(a) a planar switch plate including a first switch position having a switch component and defining first and second openings at said first switch position; and (b) a first selector button which partially extends into said first opening and which includes a projection extending toward said switch component and includes an opening for receiving therethrough said pivot pin for pivotal mounting of said selector button to said switch plate for pivotal movement between first and second pivotal positions, said switch component being attached to a side of said planar switch plate facing away from said first selector button and extending across said second opening for contact with said projection therethrough when said selector button is in said second pivotal position.

19. A switch panel according to claim 18, wherein said switch plate further includes a plurality of switch positions identical to said first switch position.

* * * * *